US006386667B1

(12) United States Patent
Cariffe

(10) Patent No.: US 6,386,667 B1
(45) Date of Patent: May 14, 2002

(54) TECHNIQUE FOR MEDIA COVERAGE USING INK JET WRITING TECHNOLOGY

(75) Inventor: Alan E. Cariffe, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 37 days.

(21) Appl. No.: 09/642,276

(22) Filed: Aug. 18, 2000

Related U.S. Application Data

(63) Continuation-in-part of application No. 09/066,621, filed on Apr. 24, 1998, now abandoned.

(51) Int. Cl.[7] ..... B41J 29/38; B41J 23/00; B41J 3/00

(52) U.S. Cl. ..... 347/12; 347/2; 347/38

(58) Field of Search ..... 347/12, 38

(56) References Cited

U.S. PATENT DOCUMENTS 5,317,337 A * 5/1994 Ewaldt ..... 347/2
5,781,221 A * 7/1998 Wen et al. ..... 347/232

* cited by examiner

*Primary Examiner*—John Barlow
*Assistant Examiner*—Alfred E Dudding

(57) ABSTRACT

An ink jet printing system includes an ink jet nozzle array for ejecting ink droplets during an ink jet printing cycle, and a flat medium positioned to receive ink droplets ejected by the nozzle array during an ink jet printing cycle. A motion apparatus provides relative motion between the nozzle array and the medium such that a spiral locus is defined by the nozzle array relative to the media during an ink jet printing cycle. The spiral maximum diameter may be made equal to the diagonal dimension of a rectangular media, thus allowing drops to be deposited very close to the edge of the media, and so reducing or eliminating the area of unprintable margins on both sides and the top and bottom of the media.

31 Claims, 10 Drawing Sheets

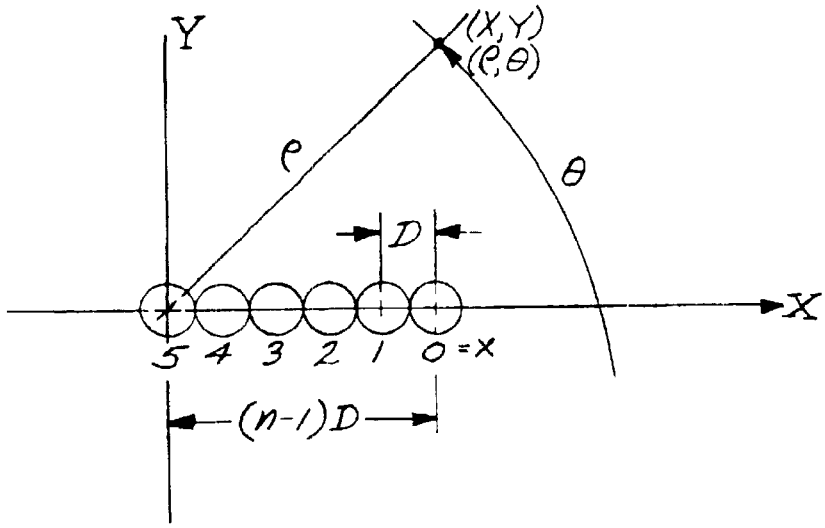
FIG. 9
FIG. 10
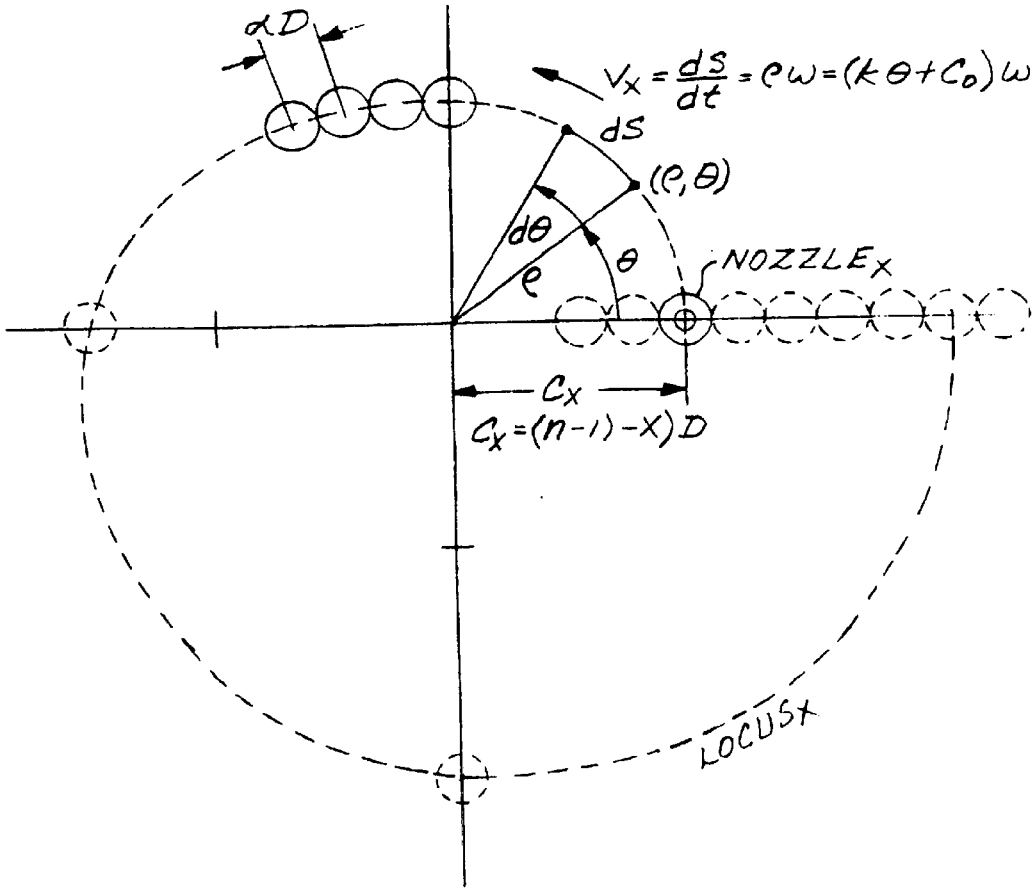

FREQUENCY RATIO $R_x = T_0/T_x = f_x/f_0$

TECHNIQUE FOR MEDIA COVERAGE USING INK JET WRITING TECHNOLOGY

CROSS-REFERENCE TO RELATED APPLICATION

This application is a continuation-in-part of application Ser. No. 09/066,621, filed Apr. 24, 1998 now abandoned, the entire contents of which are incorporated herein by this reference.

TECHNICAL FIELD OF THE INVENTION

This invention relates to ink-jet printing techniques, and more particularly to a new method for unidirectional ink-jet printing which reduces mechanical hysteresis and reduces the area of unprintable margins to zero by printing along a spiral locus path.

BACKGROUND OF THE INVENTION

There exists a method for placing drops of ink on media such that an array of nozzles is swept over the surface of a flat, rectangular media in a rectangular "raster" fashion, usually from left to right, and then back from right to left, accompanied by a step-wise motion from top-to-bottom. That method allows the ink-jet nozzle array to essentially "visit" the entire media area one or more times, depending upon the length of the top-to-bottom motion, the length of the left-to-right scan, and the offsets of the sweep start.

During the sweep, ink-jet nozzles are activated at different times to "shoot" or eject drops of ink, and these drops land upon the media, thereby making text or images visible upon the media. There are a number of undesirable artifacts which accompany the above described process. These errors are generally due to mechanical alignments within and about the mounting of the ink-jet "head", directionality errors caused by the angles with which the drops are ejected from the nozzles, timing quantization, position sensing, and importantly, mechanical hysteresis.

Hysteresis is an effect that manifests itself by a non-repeatable position trace while moving from left-to-right, and then moving from right-to-left, so that the commanded position has an uncertainty or offset from that of the actual nozzle position. Hysteresis is often the result of friction in a mechanism, accompanied by the normal tolerance of fitted parts, and accentuated by a start-stop motion of the mechanism. Starting friction may be higher than running friction; hence there is a tendency for the heads to move toward one end of their mechanical tolerance at the reversal of the sweep.

All of these effects cause the drop of ink ejected from the nozzle to land on the media with an error in position, and often there are regular visual effects which then appear as a person views the resulting image or text. Some solutions are found by overlapping the "swaths" of the sweep, or by only firing the nozzles during one of the scan directions, say from left-to-right, or by making multiple passes over the same region of the media, and choosing a drop-firing pattern which averages the mechanical errors. There are also techniques of automatic calibrations which improve the resulting print quality.

In addition to difficulties of correctly placing ink in position, a usual condition of the mechanism which handles the motion of the media in the vertical direction is that the nozzle array of the ink-jet head cannot move all the way to the edge of the media, thus prohibiting deposits of any ink drops in a margin on both the left and right sides of the media. Additionally, other mechanical constraints prohibit ink drops from being deposited on a top and also a bottom margin of the media.

SUMMARY OF THE INVENTION

In accordance with an aspect of the invention, a method is described for ink jet printing with an ink jet nozzle array having a plurality of nozzles at a different radial distance from a center of coordinates. The method comprising a sequence of the following steps;

- receiving a print job defining at least one image to be printed during an ink jet printing cycle;
- supporting a flat print medium to receive ink droplets ejected by the nozzle array during the ink jet printing cycle;
- selectively generating firing pulses to the ink jet nozzle array in dependence on the image to be printed during the ink jet printing cycle;
- providing relative rotational and translational motion between the nozzle array and the medium such that a spiral locus centered at a center of rotation coincident with the center of coordinates is defined by the nozzle array relative to the media during the ink jet printing cycle; and
- ejecting ink droplets onto the medium in response to the firing pulses during said ink jet printing cycle, including generating firing pulses for respective ones of the nozzle array at different firing rates, wherein nozzles closer to the center of coordinates are fired less frequently than nozzles further away from the center of coordinates.

In accordance with another aspect of the invention, an ink jet printing system is described, which includes an ink jet nozzle array for ejecting ink droplets during an ink jet printing cycle, the ink jet nozzle array including a plurality of nozzles disposed at a different radial distance from a printing center of coordinates. The system includes a controller for receiving data representing an image to be printed and selectively generating nozzle firing pulses dependent on the image. A flat medium is positioned to receive ink droplets ejected by the nozzle array during an ink jet printing cycle. The system further includes apparatus responsive to control signals generated by the controller for providing relative rotational and translational motion between the nozzle array and the medium relative to a center of rotation at the center of coordinates, the motion in synchronism with the firing pulses such that a spiral locus is defined by the nozzle array relative to the media to print the image during an ink jet printing cycle. The controller generates the firing pulses at different rates for respective ones of the nozzle array, wherein nozzles closer to the center of coordinates are fired less frequently than nozzles further away from the center of coordinates.

BRIEF DESCRIPTION OF THE DRAWING

These and other features and advantages of the present invention will become more apparent from the following detailed description of an exemplary embodiment thereof, as illustrated in the accompanying drawings, in which:

FIG. 9 is a schematic illustration of an ink-jet array shown in FIG. 9 consisting of n nozzles equally spaced at distance D in a straight line.

FIG. 10 illustrates the ink-jet array nozzles of the array of FIG. 9 constrained to follow loci of points on spiral curves over a flat underlying medium.

DETAILED DESCRIPTION OF THE PREFERRED EMBODIMENTS

Figure 1:
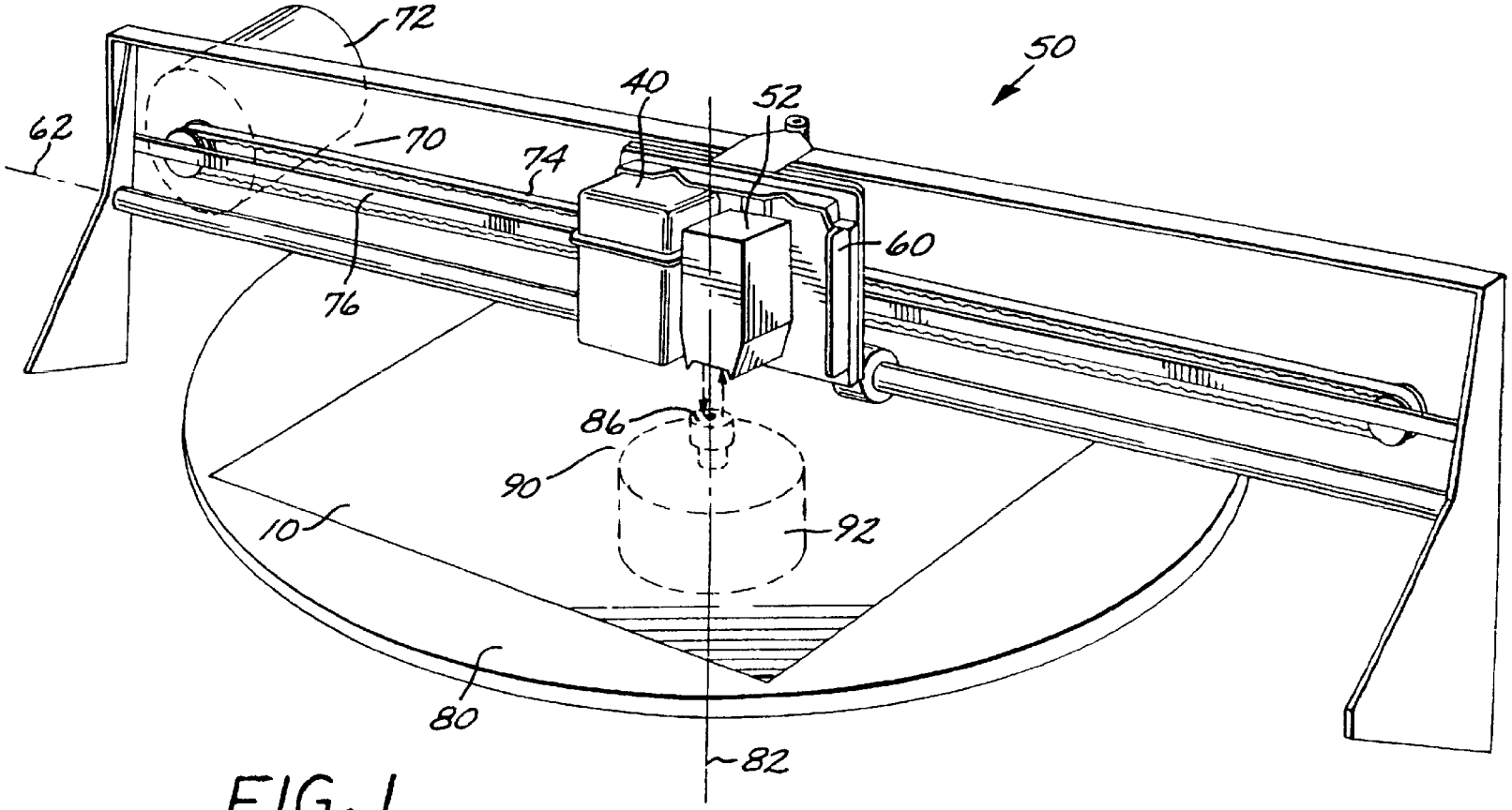
FIG. 1 is a diagrammatic isometric view of an exemplary embodiment of an ink jet printer embodying the present invention.

An ink jet printing technique is disclosed, wherein relative motion is provided between a nozzle array and the surface of a flat media, without actually causing the nozzle array or medium to stop and reverse its direction periodically, in one exemplary embodiment. This can be accomplished, in one exemplary embodiment, by mounting the nozzle array on an arm which radiates from a center of coordinates in RHO ($\rho$), THETA ($\theta$) coordinate space, where RHO is a measure of distance from a center of coordinates, and THETA is a measure of angle, most usually in radians. The nozzle array can then be moved outward from this center, while at the same time the media may be rotated in a circle around the center of coordinates. Alternatively, the nozzle array can be rotated and translated instead of the media to provide a spiral locus for the ink jet nozzles relative to the print medium.

FIGS. 1–8 illustrate an ink jet printing system 50 which embodies this invention. An ink jet pen 52 including a nozzle plate 54 with an array of ink jet nozzles 56A–56N (FIG. 3) is supported in a carriage 60. The carriage 60 is adapted for movement along a scan axis 62. A carriage drive system 70 is coupled to the carriage to drive the carriage in a path along the axis 62. Carriage drive systems are well known for swath printers, and typically include a drive motor 72, belt drive 74, and encoder strip 76 with encoder sensor 78 (FIG. 8) for providing carriage position data. The drive system for the system of FIG. 1 does not require as high speed carriage velocities as is typically required for linear swath-type printers, and so other drive mechanisms can be employed, such as leadscrew drives.

The print medium 10 is mounted on a flat turntable platen 80 which is in turn mounted for rotation about a center axis 82, which at the plane of the medium 10 defines the center of coordinates 86. The turntable platen 80 is driven by a rotary turntable drive system 90 which includes a turntable motor 92 and a turntable encoder 94 (FIG. 8) for providing turntable position data.

In an exemplary embodiment, an apparatus is provided for holding the print medium flat against the turntable. Such apparatus are well known in the art, e.g. a vacuum hold-down system, an electrostatic system, or a mechanical system with a fixture for holding the medium in place.

Figure 3:
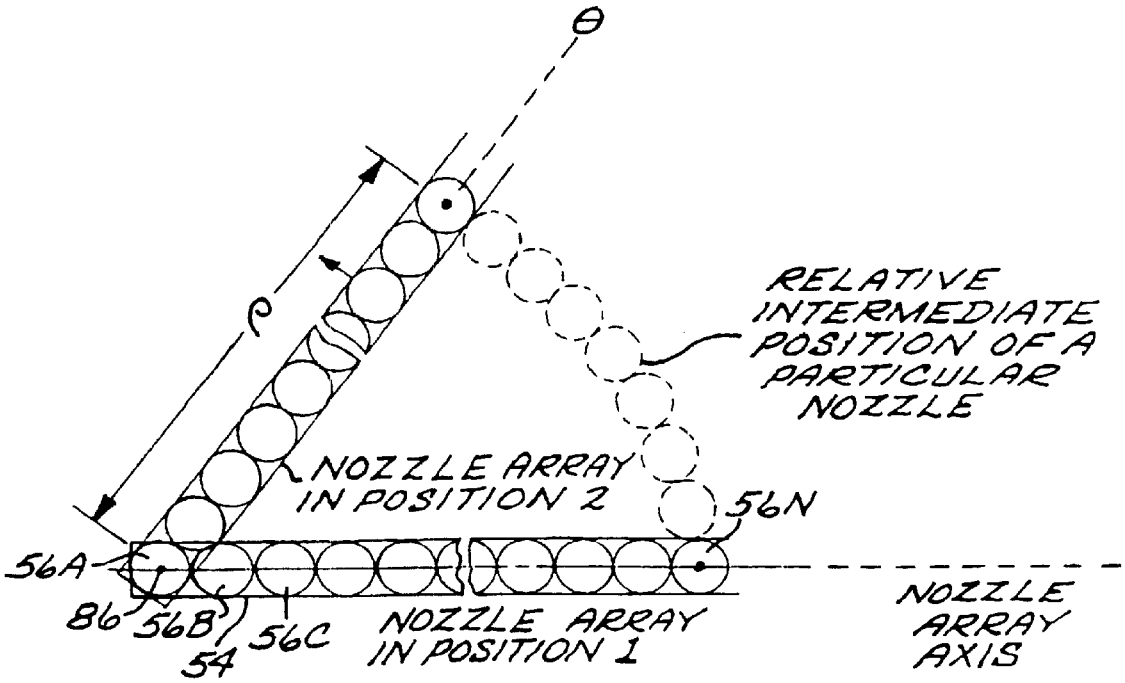
FIG. 3 illustrates a simplified nozzle array with a plurality of nozzles for the ink jet pen of the printer of FIG. 1, in two positions relative to the surface of the flat medium.

The carriage axis 62 intersects the linear nozzle array axis above the center of coordinates 86 (FIG. 3).

Also shown in FIG. 1 is a second device 40 held by the carriage. This device is optional, and can be a black ink jet pen (e.g., pen 40B in FIG. 8), in the case where the pen 52 is a tri-compartment, three color pen with three nozzle arrays for ejecting ink droplets of three different colors. Motions of the pen carriage and the media turntable may be used to allow both pens to sweep over the same regions on the medium. For example, pen 52 may sweep over a spiral when pen 40 is swept over the same area $2\pi$ radians of rotation later. Alternatively, the second device can be an optical scanning head with a light sensor array (eg. array 40A in FIG. 8), for providing an optical scanner function, as more particularly described in co-pending application Ser. No. 09/066,622, entitled "Method for Scanning Documents Using A Spiral Path Locus," the entire contents of which are incorporated herein by this reference. An exemplary optical scanning head suitable for the purpose is described in pending application Ser. No. 08/717,921, entitled UNDER-PULSED SCANNER WITH VARIABLE SCAN SPEED, P.W.M. COLOR BALANCE SCAN MODES AND COLUMN REVERSAL, by Haselby et al., filed Sep. 23, 1996, the entire contents of which are incorporated herein by this reference. In other applications, no second device 40 is employed.

Figure 2:
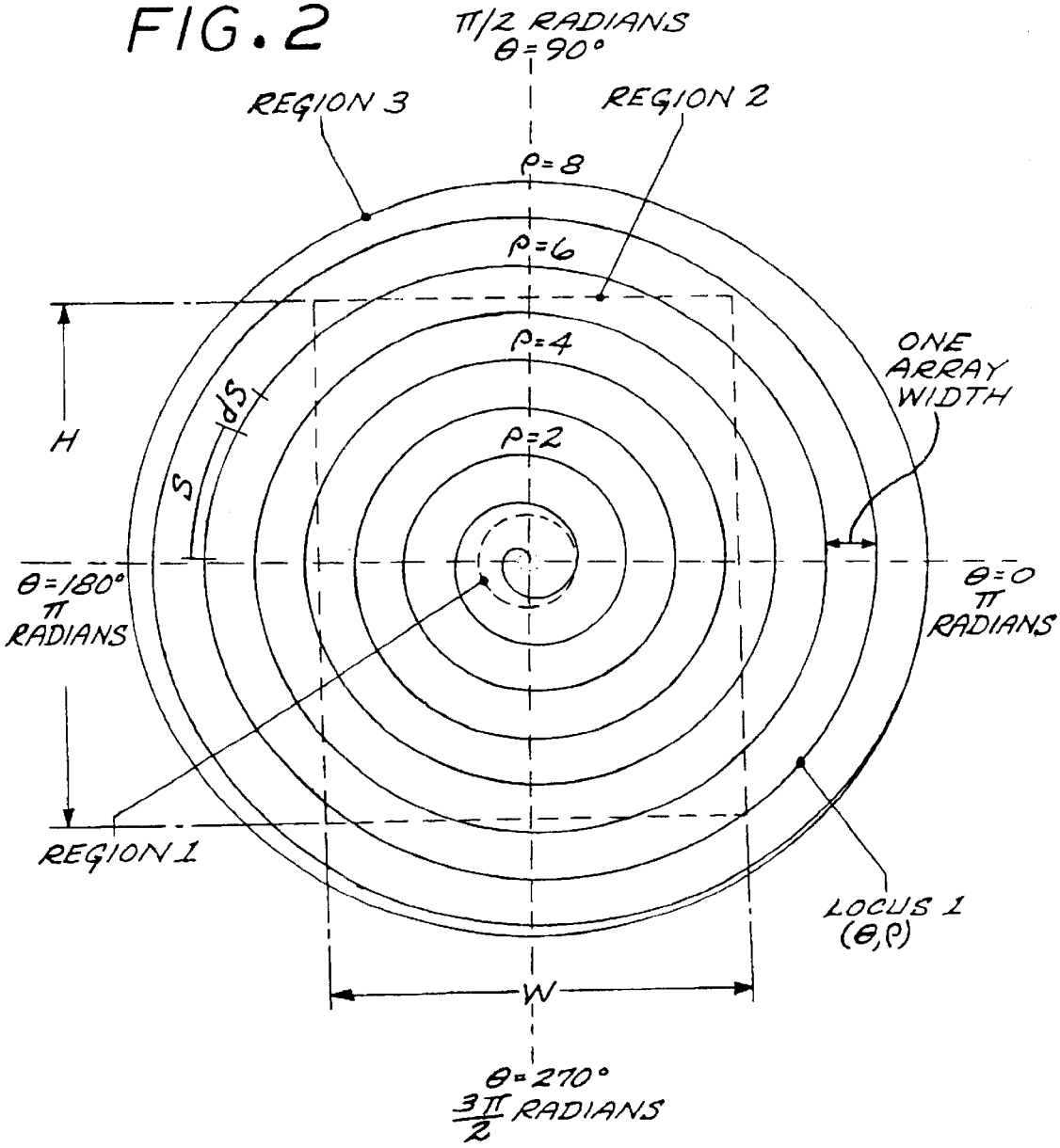
FIG. 2 is a graphical illustration of the spiral locus path of the relative motion between the ink jet pen and the flat medium, in accordance with an aspect of the invention.

FIG. 2 is a chart illustrating the relative motion path, a spiral locus, of the nozzle array in relation to the medium 10 during a printing operation in accordance with an aspect of the invention. LOCUS 1 is a trace of the path taken by the nozzle of pen 52, for example, which is mounted furthest from the center of coordinates 86, relative to the surface of the print medium 10. REGION 1 is the circular region defined by the relative nozzle sweep which would occur with a stationary nozzle array and the medium in rotation, when the nozzle array is closest to the center of coordinates 86, such that the inner nozzle is over the center of coordinates 86, and the nozzle located at the position of LOCUS 1 is the furthest from this center. REGION 2 illustrates a typical rectangular printing region, W by H. REGION 3 is bounded by a circle indicating the outer limit of coverage for potential ink drops.

FIG. 3 illustrates a simplified nozzle array 54 with a plurality of nozzles 56A–56N. Position 1 shows the nozzle array in a start position relative to the surface of the medium 10, with the nozzle 56A at the platen center of coordinates 86. Position 2 shows a relative rotation (by some angle $\theta$) between the nozzle array 54 and the medium 10. In this exemplary embodiment, the carriage is stationary during the first complete rotation of the platen 80, to provide complete coverage, i.e. to sweep out, REGION 1. This first complete relative rotation is circular, and the nozzle 56A remains at the center of coordinates 86, which is illustrated in FIG. 3. On the second rotation, the carriage is put in motion, to provide a spiral relative path as shown in FIG. 4.

Figure 4:
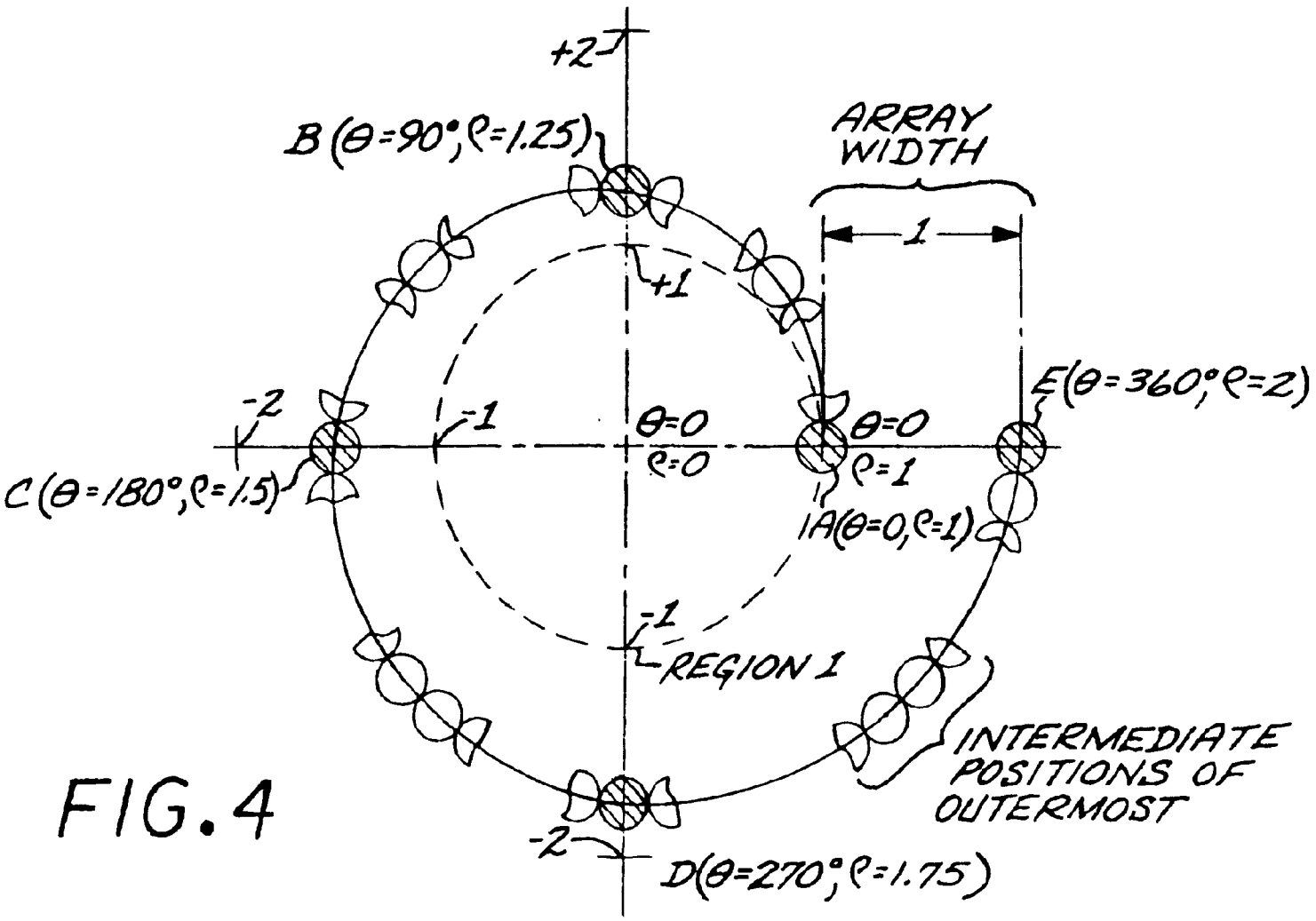
FIG. 4 is a simplified illustration of one exemplary path of the outermost nozzle of the nozzle array of FIG. 3 for a complete rotation ($2\pi$ radians) of the medium, for the case of a non-overlapped nozzle array spiral.

FIG. 4 is a simplified illustration of the path of the outermost nozzle 56N for a second complete rotation ($2\pi$ radians) of the medium 10, i.e. for the case of a given motion of the carriage along the carriage axis 62 as the platen 80 rotates. The path starts at position A of the nozzle 56N, at $\theta=0$, radius $\rho=1$ unit (equal to the width of the nozzle array), and ends at position E of the nozzle 56N, at $\theta=2\pi$, $\rho=2$ units. The nozzle 56N follows through the path illustrated relative to the medium, with position B occurring at $\theta=\pi/2$, $\rho=1.25$ unit, position C occurring at $\theta=\pi$, $\rho=1.5$ unit, and position D occurring at $\theta=3\pi/2$, $\rho=1.75$ units. During this second complete rotation, i.e. the first rotation after the carriage is put into motion, there will be overlapped coverage of print nozzles with respect to the initial rotation. Preferably, the printer controller is programmed to suppress firing the nozzles, for this second rotation, over the overlapped area to prevent duplicate dot coverage. Also, the drops or dots of ink are preferably spaced evenly along the spiral path in accordance with standard design practices.

FIGS. 2 and 4 also illustrates the condition that, for this exemplary embodiment, the radial motion of the nozzle array is constrained to move one nozzle array width in the radial direction for each $2\pi$ radians (360 degrees) rotation of the medium 10 on platen 80. Thus, in FIG. 2, the spiral path does not overlap or underlap onto itself. For the third and all subsequent rotations of the platen 80, there will be no overlapped coverage of the nozzle array relative to earlier rotations/passes of the nozzle array.

Figure 5:
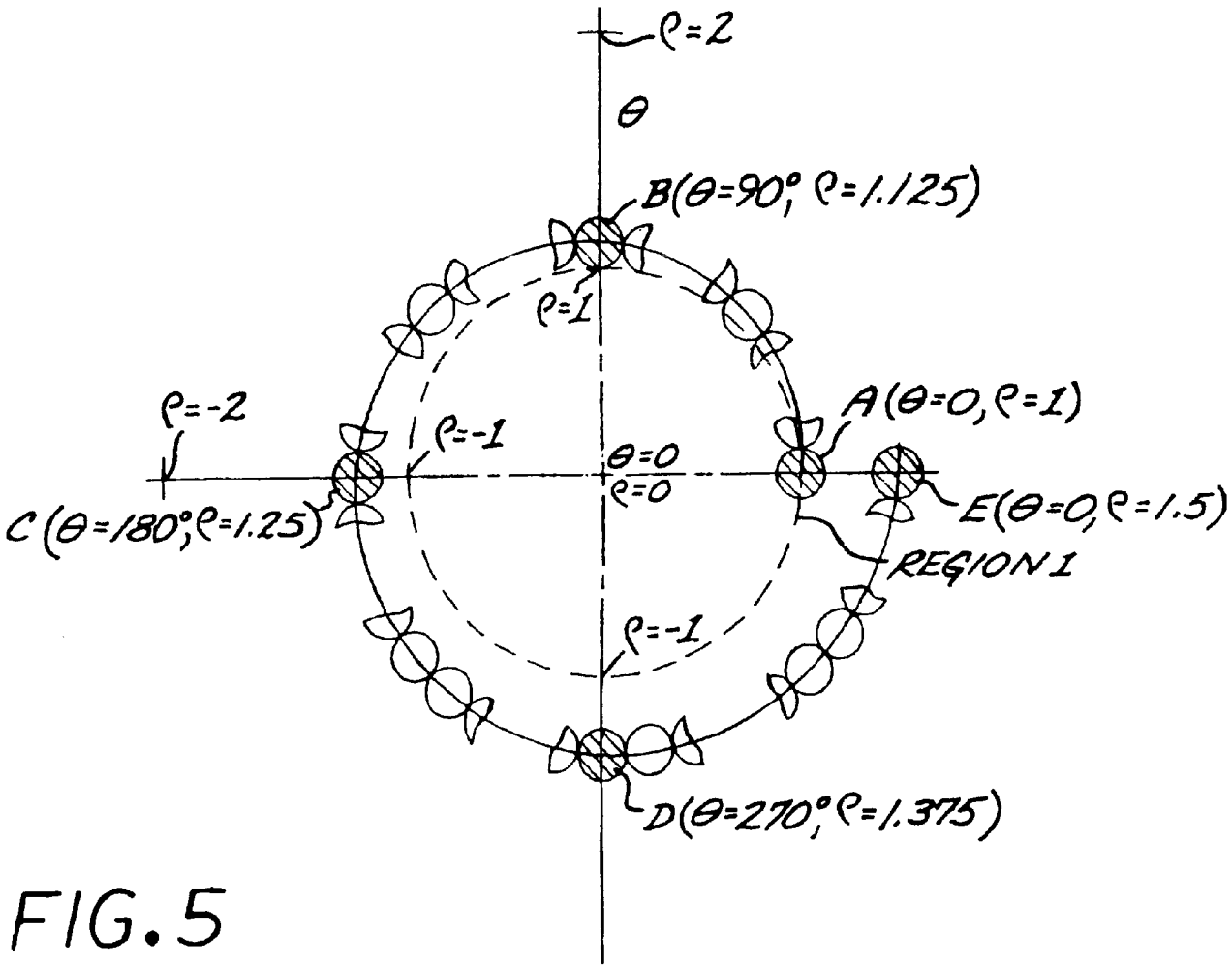
FIG. 5 is a simplified illustration of a first alternate path of the outermost nozzle of the nozzle array of FIG. 3 for a complete rotation ($2\pi$ radians) of the medium, for the case of a partially-overlapped nozzle array spiral.
Figure 6:
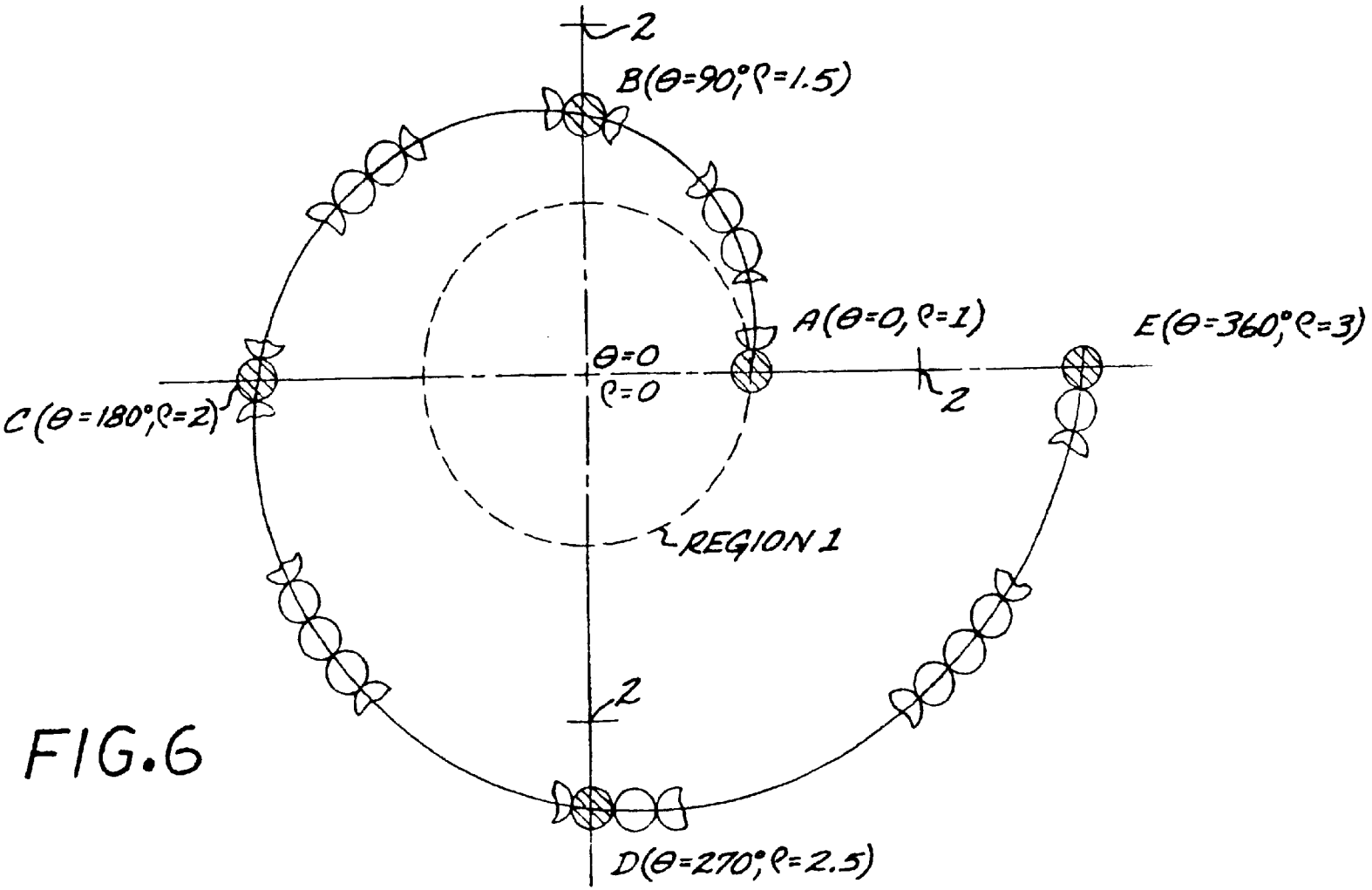
FIG. 6 is a simplified illustration of a second alternate path of the outermost nozzle of the nozzle array of FIG. 3 for a complete rotation ($2\pi$ radians) of the medium, for the case of a partially-underlapped nozzle array spiral.

In many applications it is desirable to overlap the path to prevent spiral banding, just as is presently done to prevent swath banding in known rectangular coordinate printers. In this case, then, the nozzle array will be moved less than a full nozzle array width (1 unit) for each $2\pi$ radians rotation of the medium 10. FIG. 5 illustrates an exemplary spiral locus for such an overlapped case. In this example, the carriage moves outwardly at a rate of 0.5 unit (nozzle array width) per complete rotation of the nozzle array. Alternatively, the nozzle array can be moved more than a full nozzle array width for each $2\pi$ radian rotation of the medium 10, providing gaps in the print coverage as the nozzle array moves outwardly. These gaps can be filled in on a reverse spiral scan, moving the nozzle array from an outside position back to the start position shown in FIG. 3. FIG. 6 illustrates an exemplary spiral locus for such an underlapped case. In this example, the carriage moves outwardly at a rate of 2 units (nozzle array widths) per complete rotation of the nozzle array.

In order to completely cover REGION 1 with potential ink drops, when the nozzle array is located over REGION 1, it needs to maintain this position during the first full revolution of the medium 10 on the platen 80. Subsequently, in the second and subsequent revolutions of the platen 80, as the nozzle array moves outward, all the remaining area of REGION 3 becomes the potential target of ink drops. REGION 3 is circular, but most of the media upon which it is desired to print will typically be rectangular, as illustrated by the rectangular printing REGION 2. In order to completely cover this region, the innermost nozzle of the nozzle array needs to travel away from the center of coordinates outward, and the outermost nozzle must be able to just reach the furthest corners of the media.

Figure 7:
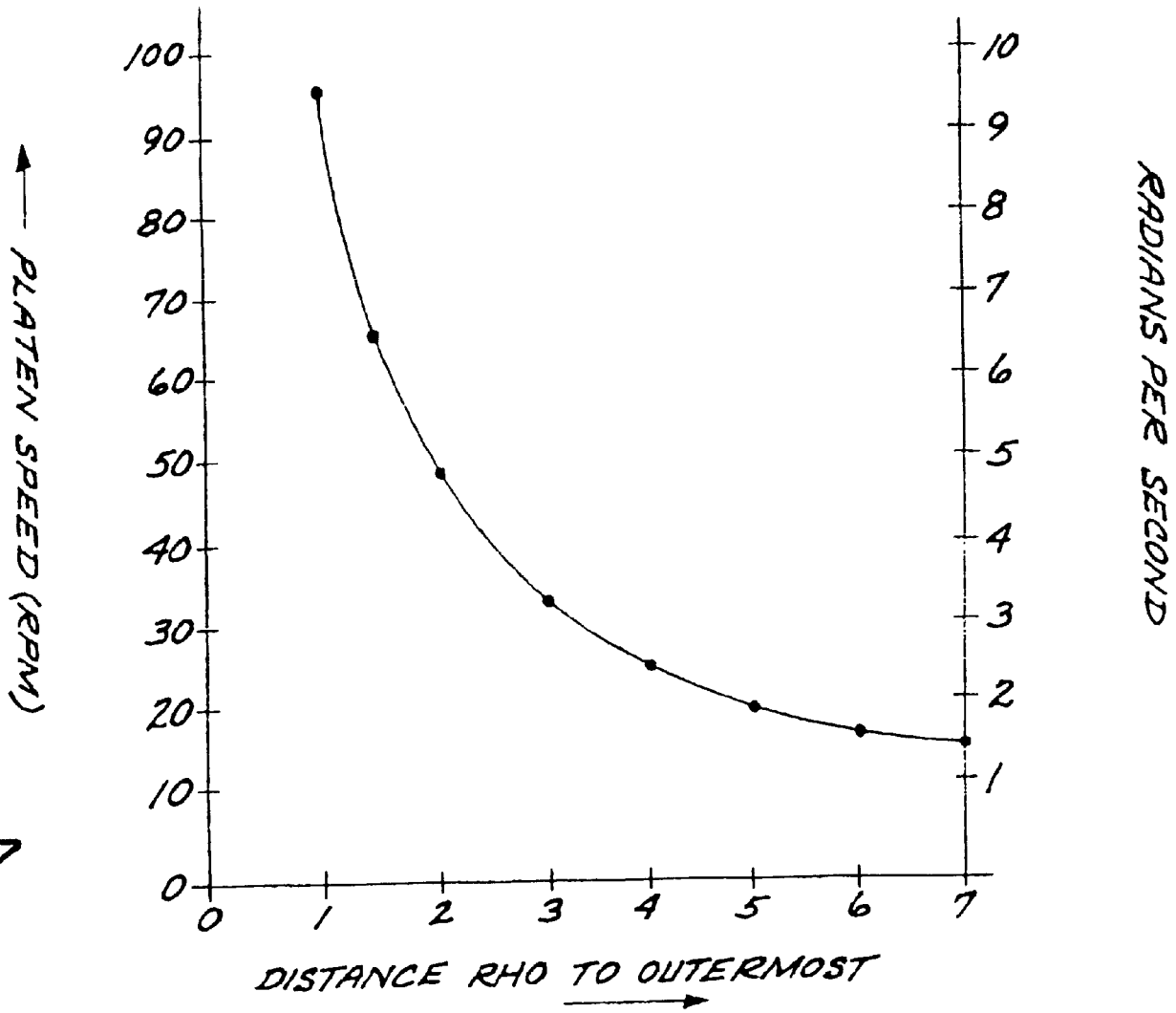
FIG. 7 is a graph of the angular speed of the flat medium as a function of radial distance to maintain a constant tangential nozzle array velocity for the embodiment of FIG. 2.

In most cases, in order to minimize the total printing time for a print job, the ink-jet nozzles fire their drops out at a constant rate, although this is not required by this invention. However, if this is a desired operation, then since the velocity of a given nozzle along the spiral would increase with radius RHO ($\rho$) for a constant rotational speed ($d\theta/dt$), the circular rotational velocity of platen 80 is adjusted such that if S is a tangential distance along LOCUS 1, and [1] dS=RHO*dTHETA using 'd' to indicate "differential" as in calculus notation, then if t stands for time, [2] dS/dt=RHO*dTHETA/dt=V, where V is the desired constant velocity along LOCUS 1. Solving [3] dTHETA/dt=V/RHO, where RHO starts out as 1 nozzle unit width, and reaches $(W^2+H^2)^{1/2}/2$ at the point where full coverage of the media has occurred. Because RHO is a variable which occurs in the denominator position, this means the rotational velocity is a nonlinear function of the position of the ink-jet head, if one desires a constant tangential velocity of the head. FIG. 7 is a graph plotting an exemplary angular speed of the head as a function of the radial distance from the center of coordinates. Expressed another way, the maximum rotational rate of the media will be V radians per second, when the innermost nozzle is located over the center of rotation, and the minimum rotational velocity will be $2V/(W^2+H^2)^{1/2}$ radians per second for a nozzle array of 1 unit length.

By way of illustrative example, assume that it is desired to print edge-to-edge on an 8.5×11 inch media using an ink-jet array which consists of 300 nozzles each of which is spaced equally from its neighbors by 1/300th of an inch. This array then is 1.0 inches long. Ink jet pens are typically designed for a maximum firing rate. Hence, the equally spaced drops dictate the distance the pen (head) moves in 1/f seconds, where f is the firing rate (frequency). This sets the maximum velocity of the pen (head). Suppose further that the maximum tangential velocity that this nozzle array supports, while firing dots at its maximum rate, is 10.0 inches per second. Thus, 10*300=3000 dots are fired per second while the head moves over the media at this speed, and the "swath-width" is 1.0 inch wide.

The maximum position the nozzle furthest from the center of rotation needs to be away from this center, for this example, is $(W^2+H^2)^{1/2}/2=(8.5^2+11^2)^{1/2}/2=6.95$ inches, and when it reaches this outer limit of RHO its rotational velocity will be dTHETA/dt=V/RHO=10.0 inches-per-second/6.95 inches=1.44 radians per second, or about 13.75 RPM (rotations per minute) as in FIG. 7. The tangential velocity is the rotational velocity times the radius, which is 1.44*6.95=10 inches per second, as expected.

Now when the nozzle furthest from the center of rotation is at RHO=1.0 inch, the rotational velocity is 10.0 inches-per-second/1.0 inches=10.0 radians-per-second, or about 95.5 RPM, as in FIG. 7.

The total print time can be approximated as the time it takes to sweep out the total circular area of REGION 3 at the constant rate of 10 square inches per second (the area swept out be the head in one second is the length of the nozzle array times the distance traveled in one second). The total "swept out" circular area is $\pi*(RADIUS^2)=3.14159*(6.95^2)=151.75$ square inches, where RADIUS is one half the diagonal dimension of REGION 2. At 10 square inches per second, this is about 15.2 seconds.

In the case wherein an image is rendered which is typically organized, in a conventional fashion, in rows and columns of data pixels, or picture elements, there are some regions of the media where the drops may not land exactly upon the desired "cartesian" coordinate due to quantization-type effects which exist between the Cartesian coordinate system of rows and columns, and the RHO-THETA coordinate system illustrated in FIG. 2. The maximum error in the above schemata will occur at a rotation angle of 180 degrees, or $\pi$ radians, with $\pi$ representing the ratio of the circumference to the diameter of a perfect circle. By re-sampling the raster cartesian data into RHO-THETA coordinates, using known digital techniques (e.g.

convolution), printing artifacts will be minimal. Co-pending application Ser. No. 09/066,622, entitled "Technique for Scanning Documents Using A Spiral Path Locus," describes a technique to eliminate the need for such coordinate conversions altogether.

Figure 8:
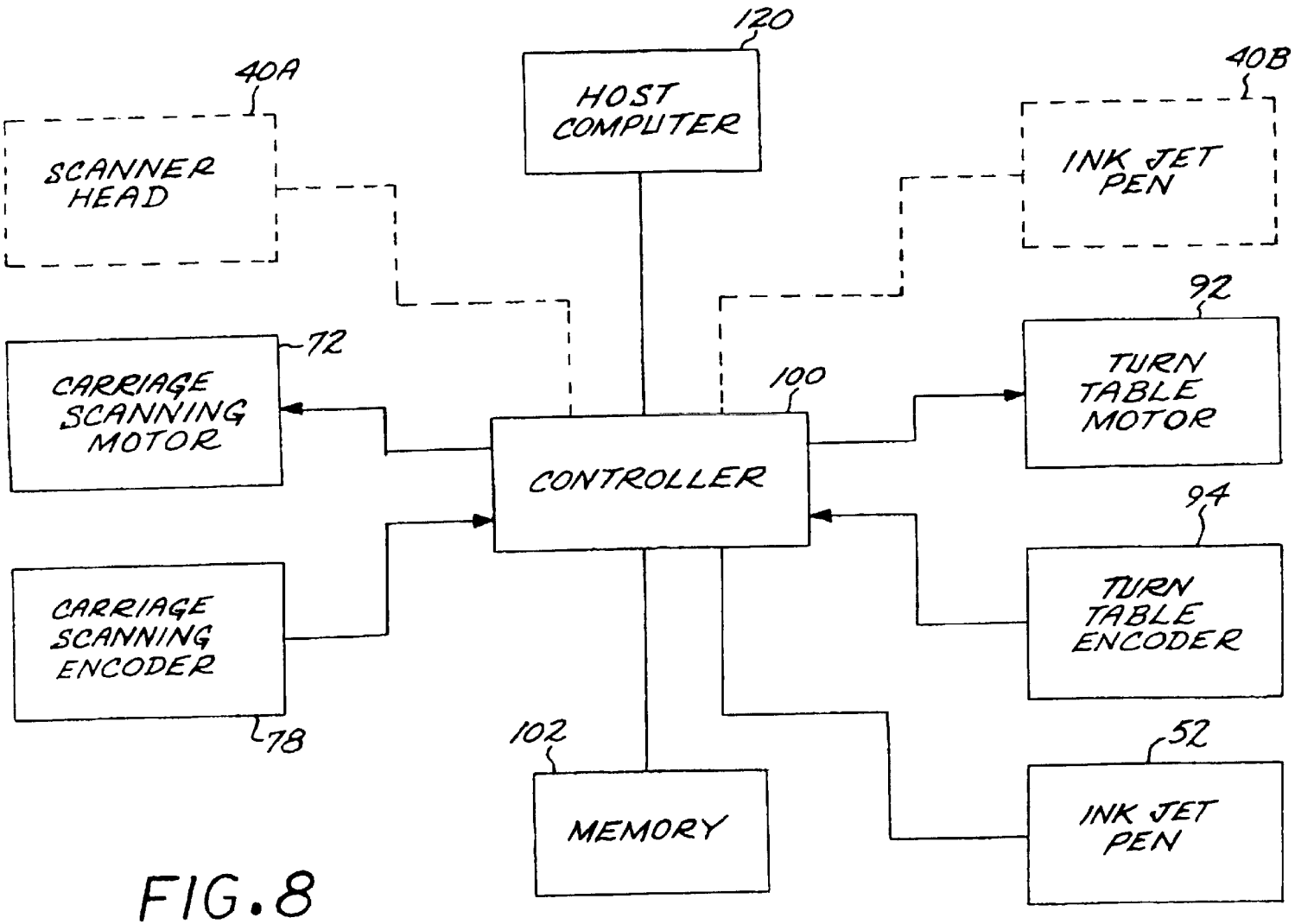
FIG. 8 is a simplified schematic block diagram of the control system comprising the printer apparatus of FIG. 1.

FIG. 8 is a simplified schematic block diagram of the control system for the printer system illustrated in FIG. 1. A controller 100 is coupled to a memory 102 for retieval of data defining a print job. The controller generates the drive commands to the pen scanning motor 72, which comprises the carriage drive, and receives position signals indicative of the carriage/pen position from pen scanning encoder 78. The controller also generates turntable motor drive commands to control the turntable motor 92 which rotates the turntable platen, and receives encoder signals from the turntable encoder 94 to determine the position and angular velocity of the turntable platen. The controller thus can control the carriage drive to achieve a non-overlapping spiral locus of the pen nozzle array with respect to the medium, or an overlapped spiral locus to prevent banding or other artifacts, or an underlapped locus to provide for other special printing modes. Other exemplary print modes include skipping printing on alternate rotations forming the spiral, and to reverse the direction of the carriage at the end, filling in the omitted dots in the alternate rotations.

The controller also provides firing pulses to the pen printhead nozzles 54, in dependence on the image to be generated and the position of the pen in relation to the center of coordinates. The image data can be stored in the memory 102, or received from a host computer 120. The controller can also set the firing rate for the pen nozzles. While in many cases it is desirable to use a constant (maximum) firing rate, for other jobs or applications, the controller can control the firing rate to be non-constant over a particular print job, or to use a slower constant firing rate. Faster or slower firing rates can be used to achieve higher or lower densities of dots in particular regions on the medium 10.

Each nozzle in the nozzle array 54 is at a different radial distance from the center of coordinates 86 than any other nozzle. The result of this is that firing all nozzles at a constant rate produces dot spacing differences which will be readily apparent at small values of RHO, especially in REGION 1 of FIG. 2. For example, in REGION 1 during the initial rotation of the media (which is not accompanied by a radial motion of the carriage), and for a $1/300^{th}$ inch nozzle spacing, the nozzle 56N (FIG. 3) at RHO furthest from the center of rotation must fire 300 times for every inch along the circumference. For a one inch nozzle array, the circumference is $2\pi$ inches. Hence there will be 1,885 dots printed at a spacing of $1/300^{th}$ of an inch along this circumference. At the second nozzle 56B out from the center of coordinates, the circumference is only $2\pi/300$ inches, or 0.0209 inch, and firing 1,885 dots of ink along this circular path is incorrect because it will produce too much ink along that circular path. At the nozzle next to the outermost nozzle, i.e. 1/300 inch closer to the center of rotation, the number of dots fired to maintain 300 dots per inch should be $2\pi(1.0-1/300)(300)$, which is 1,879. Instead, however, 1,885 dots would actually be fired if the firing rate were to be the same as the outermost nozzle, and the dots thus produced would be closer together than those produced by the outermost nozzle. During the sweep of REGION 1, or at any other region of the medium, pixels which have been printed should not be re-printed, and logic in the controller can easily determine which pixel is to be printed by each nozzle, and nozzles closer to the center of rotation can be fired less frequently.

As an example, when the nozzle array has reached a RHO value of 2.0, after the second complete rotation of the medium, the nozzle 56A (closest to the center of rotation) is at a RHO value of 1.0, and will need to be fired at one-half the rate of the outermost nozzle to maintain the same dot spacing. Again, logic in the controller will adjust the firing rate to not put ink on a pixel which has already been printed once. However, it is desired to minimize total print time by making the nozzle 56N, i.e. the outermost nozzle, fire at the maximum (constant) rate possible. FIG. 7 shows the relationship between the constant (maximum) rate of this outermost nozzle, while all other nozzles will actually fire when the pixel over which they are to print is at least $1/300^{th}$ of an inch away from any adjacent pixel, and this will always be at a lower rate of firing than the maximum possible. These differences in rate rapidly diminish with distance from the center of rotation.

Thus, for many applications, it will be desirable to fire the nozzles in the array at different firing rates. Consider the ink-jet array shown in FIG. 9 consisting of n nozzles equally spaced at distance D in a straight line. The nozzles are aligned with a radial line extending from an origin of coordinates (which is coincident with a center of rotation) in a two dimensional coordinate system ($\rho$, $\theta$) Polar, or (X, Y) cartesian system, such that $\text{nozzle}_0$ is furthest from the origin of coordinates (starting out at (n−1)D distance from the origin of coordinates) and $\text{nozzle}_{n1}$ is closer to and starts out at the center of coordinates.

The ink-jet array nozzles of the array of FIG. 9 may each be constrained to follow loci of points on spiral curves over a flat underlying medium by relatively moving the array outward or inward radially from the origin of coordinates and simultaneously relatively rotating the medium through an angle $\theta$, such that the relationship between the radial distance $\rho$ from the origin to any nozzle has the relationship $\rho=K\theta+C$, as shown in FIG. 10. K is an arbitrary constant, and $\theta$ is in radians. K determines how close points on the spiral are to each other along a given radial line from the origin intersecting the loci, and C is an initial offset distance from that origin to a given nozzle. Let x be the index number of a given $\text{nozzle}_x$:

$$C_x=(n-1-x)D \qquad [0]$$

Alternatively, the ink-jet nozzle array may be rotated around the origin of coordinates while being simultaneously moved radially, or a combination of medium and nozzle array motion may be made to accomplish the same spiral loci between medium and any nozzle.

The distance $S_{osc}$ along the osculating circle (a best fitting circle tangent to the spiral locus at a particular point on the locus) having a radius r and with subtended angle $\phi$ is $$S_{osc}=r\phi \qquad [1]$$

For tiny changes in $\phi$, $S_{osc}$ approaches with arbitrary precision the distance S $\text{nozzle}_0$ moves tangentially along $\text{LOCUS}_0$, the spiral locus defined with the constraints above for nozzle 0.

If $S_0$ is the tangential distance nozzles moves along spiral $\text{LOCUS}_0$, and $\rho_0$ is the distance from the origin to $\text{nozzle}_0$, at any point on $\text{LOCUS}_0$, then by analogy to equation [1]

$$dS_0=\rho_0 d\theta \qquad [2]$$

using 'd' to indicate "differential" as used in calculus notation; then if t stands for time, the tangential velocity $V_0$ of $\text{nozzle}_0$ along $\text{LOCUS}_0$ is given by $$V_0=dS_0/dt=\rho_0 d\theta/dt=\rho_0\omega=(K\theta+C_0)\omega \qquad [3]$$

where $V_0$ is a desired constant velocity along $LOCUS_0$ and $\omega = d\theta/dt$ represents the medium-relative angular velocity of nozzle $V_0$ achieved either by rotating the medium or by rotating the nozzle array around a center of coordinates coincident with the center of rotation. Now since a desirable condition is to keep $V_0$ at a constant value while $\rho_0$ changes with the angle $\theta$, a result from [3] is to constrain $\omega$ as a function of $\theta$ or $\rho_0$, thus:

$$\omega = V_0/(K\theta + C_0) = V_0/\rho_0 \quad [3a]$$

This means that the angular rotational speed $\omega$ of the ink-jet nozzle array goes down as the rotation angle $\theta$ increases, or the angular rotational speed $\omega$ of ink-jet $nozzle_0$ is made inversely proportional to the distance from the center of rotation, holding $V_0$ constant.

In a typical case, it is desired to fire drops of ink from $nozzle_0$ and the other nozzles 1,2,3, . . . (n−1) at a constant loci coincident spacing, i.e. the drops are positioned along the loci in a curvilinear manner, the usual spacing being $\alpha D$, where $\alpha$ is often a constant between approximately 0.5 and 2.0 plus or minus, and D represents the linear distance between nozzles on the ink-jet array. Most usually D is a constant whose value is approximately the diameter of a droplet of ink after it has marked the medium, plus or minus.

If $nozzle_0$, whose tangential velocity along $LOCUS_0$ is constant at value $V_0$ following the above constraints, is firing droplets of ink at a spacing along the spiral curve $LOCUS_0$ of $\alpha D$, or D when $\alpha$ is, say, 1.0, the firing pulses to $nozzle_0$ will be come at a regular interval time period $T_0$ of $$T_0 = D/V_0 = D/(\rho_0 \omega) \quad [4]$$

For example, if D is $1/300^{th}$ of an inch, and $V_0$ is 10 inches per second, then the regular interval period of firing drops from $nozzle_0$ is $(1/300)/10$, or $1/3000$ second. It is desired to calculate the interval firing periods for each of the other (n−1) nozzles in the ink-jet array, each period of which will differ from $nozzle_0$ and will change as $\rho_x$ changes. Nevertheless, $T_0$ will remain constant.

Let $\rho_0$ be the radial distance of $nozzle_0$ from the center of rotation while $nozzle_0$ is constrained by the system to move on $LOCUS_0$ with constant tangential velocity $V_0$.

Let $\rho_1 = \rho_0 - D$, $\rho_2 = \rho_0 - 2D$, $\rho_3 = \rho_0 - 3D$ and so on up to $\rho_{(n-1)} = \rho_0 - (n-1)D$, as a consequence of the equally spaced nozzles of the ink-jet array (although this method applies with slight variation for non-equally spaced nozzles and nozzle arrays at an angle to a radial line passing through the center of rotation coincident with the center of coordinates).

At any given instant, nozzles closer to the center of rotation have tangential velocities along their respective loci in proportion to their distances from the origin. So the firing periods for each nozzle will be:

$$T_0 = D/V_0 \quad [4a]$$

$$V_1 = V_0(\rho_1/\rho_0) \quad [4b]$$

$$T_1 = D/V_1 = D/(V_0(\rho_1/\rho_0)) = (D\rho_0)/((\rho_0 - 1D)V_0) \quad [5]$$

$$T_2 = D/V_2 = D/(V_0(\rho_2/\rho_0)) = (D\rho_0)/((\rho_0 - 2D)V_0) \quad [6]$$

$$T_x = D/V_x = D/(V_0(\rho_x/\rho_0)) = (D\rho_0)/((\rho_0 - xD)V_0) \quad [7]$$

The ratio $R_x$ will now be defined as the ratio of the time period $T_0$ to $T_x$ so a given firing period for an arbitrary $nozzle_x$ can be calculated based on the firing period for $nozzle_0$, which is constant. The remaining nozzles have firing periods which vary.

$$R_x = T_0/T_x = (D/V_0)/((D\rho_0)/((\rho_0 - xD)V_0)) = (\rho_0 - xD)/\rho_0 \quad [8]$$

$$R_x = (K\theta + C_0 - xD)/(K\theta + C_0) \quad [9]$$

The firing frequency $f_x$ of a nozzle is given by the following relationship:

$$f_x = 1/T_x \quad [10]$$

Thus, the firing frequency of nozzle 0 is given by:

$$F_0 = 1/T_0 \quad [11]$$

From this, it will be apparent that the firing frequency ratio $R_x$ of a nozzle relative to the firing frequency of nozzle 0 is given by equation 12:

$$R_x = T_0/T_x = (1/f_0)/(1/f_x) = f_x/f_0 \quad [12]$$

Figure 11:
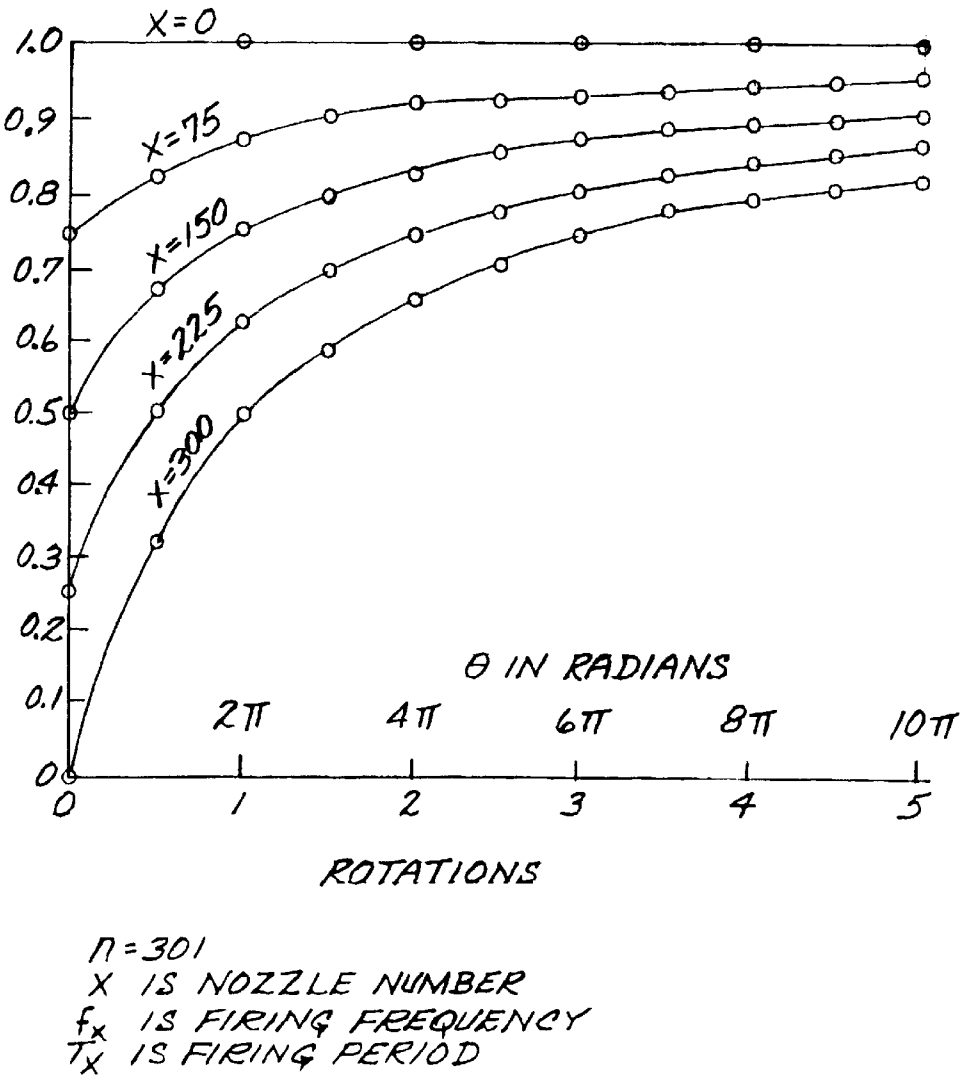
FIG. 11 plots the ratio of firing frequency of a given nozzle of the array of FIG. 9 relative to nozzle 0 as a function of $\theta$.

This relationship is graphically illustrated in FIG. 11, which plots the ratio of firing frequency of a given $nozzle_x$ relative to $nozzle_0$ of a 301 nozzle array as a function of $\theta$.

While one approach is to vary the rotation rate to maintain a constant tangential velocity and firing rate of the outermost nozzle 0, another approach is to maintain a constant rotation rate $\omega$ and vary the firing rate f of $nozzle_0$ as a function of the radial distance from the center of rotation in order to maintain equal drop spacing along $LOCUS_0$. In this case, the firing rate of $nozzle_0$ would decrease with increasing radial distance from the center of rotation, because the tangential velocity $V_0$ would increase with increasing $\rho_0$. Alternatively, for some applications, the printing can be performed with a non-constant rotation rate and a non-constant firing rate. In all these cases, the relative firing rate ratios indicated by FIG. 11 would still instantaneously hold, however the independent variable axis $\theta$ would be nonlinear.

The foregoing analysis has assumed that each possible landing site for a drop has been the recipient of an ink droplet; however in image formation and rendering it is obvious that not all potential sites receive ink, and hence the firing pulses to those nozzles above some sites will be suppressed. In an ink-jet printing system, the spiral printing may also employ all the techniques of dithering, error-diffusion, super-pixeling and other commonly employed rendering techniques known by those skilled in the art.

It is understood that the above-described embodiments are merely illustrative of the possible specific embodiments which may represent principles of the present invention. For example, other arrangements can be employed to provide the desired relative motion between the pen and the print medium to provide a spiral path. For example, the pen can located on an arm mechanism which moves in a spiral path, with the print medium located on a stationary platen. Or conversely, the pen can be located in a stationary position, and the print medium located on a platen which provides the desired spiral movement locus. Also, while the motion of the pen has been described as commencing from a position at the center of coordinates and moving radially outwardly, the pen could alternatively be started at any other position, e.g., at the outermost position and spiraled inwardly to end at the center of coordinates. Other arrangements may readily be devised in accordance with these principles by those skilled in the art without departing from the scope and spirit of the invention.

What is claimed is:

1. A method for printing with an ink jet nozzle array having a plurality of nozzles at a different radial distance from a center of coordinates, comprising;

receiving a print job defining at least one image to be printed during an ink jet printing cycle;

supporting a flat print medium to receive ink droplets ejected by the nozzle array during the printing cycle;

selectively generating firing pulses to the ink jet nozzle array in dependence on the image to be printed, including generating firing pulses for respective ones of the nozzle array at different firing rates, wherein nozzles closer to the center of coordinates are fired less frequently than nozzles further from the center of coordinates;

providing relative rotational and translational motion between the nozzle array and the medium such that a spiral locus centered at a center of rotation coincident with the center of coordinates is defined by the nozzle array relative to the medium; and ejecting ink droplets onto the medium in response to the firing pulses during said printing cycle.

2. The method of claim 1, wherein said step of providing relative motion is accomplished without causing the nozzle array to stop and reverse its direction periodically during the printing cycle.

3. The method of claim 1 wherein said nozzle array is mounted on an arm which radiates from a center of coordinates, and wherein said step of providing relative motion includes moving the nozzle array outwardly on the arm from the center of coordinates while rotating the medium about the center of coordinates.

4. The method of claim 3 wherein the nozzle array spans an array distance in a direction extending radially from the center of coordinates, and said step of providing relative motion includes moving the nozzle array radially at a rate such that the nozzle array is moved radially by a distance equal to the array distance for each complete rotation of the medium about the center of coordinates.

5. The method of claim 3 wherein the nozzle array spans an array distance in a direction extending radially from the center of coordinates, and said step of providing relative motion includes moving the nozzle array radially at a rate such that the nozzle array is moved radially by a distance which is less than the array distance for each complete rotation of the medium about the center of coordinates.

6. The method of claim 1 wherein said step of providing relative motion between the nozzle array and the medium includes moving the nozzle array radially at a rate selected to provide a partial overlap of the nozzle array relative to the medium during the printing cycle.

7. The method of claim 1 wherein said step of providing relative motion between the nozzle array and the medium includes moving the nozzle array radially at a rate selected to provide a partial underlap of the nozzle array relative to the medium.

8. The method of claim 1 wherein the medium has an area, and the step of providing relative movement includes moving the nozzle array radially by a distance which is large enough to provide swept coverage of the nozzle array over the entire area of the medium.

9. The method of claim 1 wherein said step of receiving a print job including receiving the print job as a set of rows and columns of data pixels in a cartesian coordinate relationship, and converting the print job from a cartesian coordinate relationship to a set of converted data pixels in a RHO-THETA coordinate system relationship.

10. The method of claim 1 wherein the step of receiving a print job includes receiving a print job defining a multiple color image, the step of providing an ink jet nozzle array includes providing a multicolor nozzle array set, said step of selectively generating firing pulses includes selectively generating firing pulses to the nozzle array set in dependence on the multiple color image, and said step of ejecting ink droplets includes ejecting ink droplets of different colors in response to the firing pulses.

11. The method of claim 1 wherein said step of providing relative rotation and translational motion includes varying a relative rotation rate to maintain a constant tangential velocity of one of said nozzles throughout said printing cycle.

12. The method of claim 1 wherein said one of said nozzles is an outermost nozzle at the furthest radial distance from the center of rotation of the nozzles of the nozzle array.

13. The method of claim 12 wherein said step of selectively generating firing pulses includes generating firing pulses at a constant firing rate for the outermost nozzle for the printing cycle to provide ink droplets emitted by the outermost nozzle which are equally spaced along the spiral locus.

14. The method of claim 1 wherein the nozzle array includes n nozzles equally spaced at distance D in a straight line aligned with a radial line extending from the polar origin of coordinates ($p=0.\theta=0$) such that $\text{nozzle}_0$ is furthest from the origin of coordinates (starting out at (n−1)D distance from the origin of coordinates) and $\text{nozzle}_{n-1}$ is closer to and starts out at the center of coordinates, and wherein the relative firing rate of the inner nozzles relative to the outermost nozzle are given by $$R_x=(K\theta+C_0-xD)/(K\theta+C_0),$$

where angle θ is in radians, K is an arbitrary constant, and C is an initial offset distance from that origin to a given nozzle.

15. The method of claim 1 wherein said step of providing relative rotational and translational movement includes conducting a first complete relative rotation of the array about the center of rotation without translation of the array away from the center of rotation to provide complete swept coverage of the circular region subtended by the array nozzles during the first rotation, and providing relative translational as well as rotational movement for subsequent rotations of the array.

16. The method of claim 1 wherein said step of providing relative rotational and translational motion includes maintaining a constant rotation rate, and the step of selectively generating firing pulses includes varying the firing frequency of the outermost nozzle as a function of radial distance from the center of coordinates to provide for constant drop spacing for drops emitted by the outermost nozzle.

17. An ink jet printing system, comprising:

an ink jet nozzle array for ejecting ink droplets during an ink jet printing cycle, the ink jet nozzle array including a plurality of nozzles disposed at a different radial distance from a printing center of coordinates;

a controller for receiving data representing an image to be printed and selectively generating nozzle firing pulses dependent on the image;

a flat medium positioned to receive ink droplets ejected by the nozzle array during an ink jet printing cycle;

apparatus responsive to control signals generated by the controller for providing relative rotational and translational motion between the nozzle array and the medium relative to a center of rotation at the center of coordinates, said motion in synchronism with said firing pulses such that a spiral locus is defined by the nozzle array relative to the media to print said image during an ink jet printing cycle; and wherein said controller generates said firing pulses at different rates for respective ones of the nozzle array, wherein nozzles closer to the center of coordinates are fired less frequently than nozzles further away from the center of coordinates.

18. The printing system of claim 17, wherein said apparatus for providing relative motion is adapted to provide said relative motion without causing the nozzle array to stop and reverse its direction periodically during the printing cycle.

19. The printing system of claim 17 wherein said apparatus for providing relative motion between the nozzle array and the medium is adapted to move the nozzle array radially at a rate which provides a partial overlap of the nozzle array relative to the medium during the printing cycle.

20. The printing system of claim 17 wherein said apparatus for providing relative motion between the nozzle array and the medium is adapted to move the nozzle array radially at a rate which provides a partial underlap of the nozzle array relative to the medium.

21. The printing system of claim 17 further comprising:

an ink jet pen, wherein said nozzle array is mounted on said pen;

a pen carriage for holding the pen, said pen carriage mounted for movement along a carriage axis extending through an center of coordinates;

an arm structure for supporting the pen carriage for said movement along said carriage axis; and wherein said apparatus for providing relative motion includes a carriage drive apparatus for moving the pen outwardly on the arm from the center of coordinates and a turntable drive for rotating the medium about the center of coordinates.

22. The printing system of claim 21 wherein the nozzle array spans a first distance in a direction extending radially from the center of coordinates, and said carriage drive apparatus is adapted to move the nozzle array radially at a rate such that the nozzle array is moved radially by a distance equal to the first distance for each complete rotation of the medium about the center of coordinates.

23. The printing system of claim 21 wherein the nozzle array spans a first distance in a direction extending radially from the center of coordinates, and said carriage drive apparatus is adapted to move the nozzle array radially at a rate such that the nozzle array is moved radially by a distance which is less than the first distance for each complete rotation of the medium about the center of coordinates.

24. The printing system of claim 17 wherein the apparatus for providing relative movement is adapted to move the nozzle array radially by a distance which is large enough to provide swept coverage of the nozzle array over the entire area of the medium.

25. The system of claim 17 wherein said controller is responsive to a print job received as a set of rows and columns of data pixels in a cartesian coordinate relationship, to convert the print job from a cartesian coordinate relationship to a set of converted data pixels in a RHO-THETA coordinate system relationship.

26. The system of claim 17 wherein the controller is for receiving a print job defining a multiple color image, the ink jet nozzle array includes a multicolor nozzle array set for ejecting ink droplets of different colors in response to the firing pulses.

27. The printing system of claim 17 wherein said apparatus for providing relative rotation and translational motion varies a relative rotation rate to maintain a constant tangential velocity of one of said nozzles throughout said printing cycle.

28. The printing system of claim 27 wherein said one of said nozzles is an outermost nozzle at the furthest radial distance from the center of rotation of the nozzles of the nozzle array.

29. The printing system of claim 28 wherein controller generates firing pulses at a constant firing rate for the outermost nozzle for the printing cycle to provide ink droplets emitted by the outermost nozzle which are equally spaced along the spiral locus.

30. The printing system of claim 17 wherein the nozzle array includes n nozzles equally spaced at distance D in a straight line aligned with a radial line extending from the origin of coordinates (p=0.θ=0) such that $nozzle_0$ is furthest from the origin of coordinates (starting out at (n−1)D distance from the origin of coordinates) and $nozzlen_{n-1}$ is closer to and starts out at the center of coordinates, and wherein the relative firing rate of the inner nozzles relative to the outermost nozzle are given by $$R_x=(K\theta+C_0-xD)/(K\theta+C_0),$$

where angle θ is in radians, K is an arbitrary constant, and C is an initial offset distance from that origin to a given nozzle.

31. The printing system of claim 17 wherein said controller controls the apparatus for providing relative rotational and translational movement to conduct a first complete relative rotation of the array about the center of rotation without translational of the array away from the center of rotation to provide complete swept coverage of the circular region subtended by the array nozzles during the first rotation, and to provide relative translational as well as rotational movement for subsequent rotations of the array.

* * * * *

UNITED STATES PATENT AND TRADEMARK OFFICE

CERTIFICATE OF CORRECTION

PATENT NO. : 6,386,667 B1
DATED : May 14, 2002
INVENTOR(S) : Alan E. Cariffe

It is certified that error appears in the above-identified patent and that said Letters Patent is hereby corrected as shown below:

Column 14,
Line 31, “nozzlen” should read -- nozzle --;

Signed and Sealed this

Twenty-eighth Day of January, 2003

JAMES E. ROGAN
*Director of the United States Patent and Trademark Office*